US010605245B2

(12) United States Patent
Dieckhaus et al.

(10) Patent No.: US 10,605,245 B2
(45) Date of Patent: Mar. 31, 2020

(54) CENTRIFUGAL PUMP ASSEMBLIES HAVING AN AXIAL FLUX ELECTRIC MOTOR AND METHODS OF ASSEMBLY THEREOF

(71) Applicants: Regal Beloit America, Inc., Beloit, WI (US); Regal Beloit Australia Pty Ltd., Rowville, Vicotria (AU)

(72) Inventors: Samuel Augustin Dieckhaus, Milwaukee, WI (US); Teng Wu, San Jose, CA (US); Matthew J. Turner, Melbourne (AU); Jason Jon Kreidler, Sheboygan, WI (US)

(73) Assignees: REGAL BELOIT AMERICA, INC., Beloit, WI (US); REGAL BELOIT AUSTRALIA PTY LTD, Rowville (AU)

( * ) Notice: Subject to any disclaimer, the term of this patent is extended or adjusted under 35 U.S.C. 154(b) by 225 days.

(21) Appl. No.: 15/704,750

(22) Filed: Sep. 14, 2017

(65) Prior Publication Data

US 2019/0078571 A1 Mar. 14, 2019

(51) Int. Cl.

| | |
|---|---|
| ***F04D 29/22*** | (2006.01) |
| ***F04D 13/06*** | (2006.01) |
| ***F04D 29/047*** | (2006.01) |

(52) U.S. Cl.

CPC ..... *F04D 13/0633* (2013.01); *F04D 13/0666* (2013.01); *F04D 29/0473* (2013.01); *F04D 29/22* (2013.01)

(58) Field of Classification Search

CPC ..... H02K 2205/03; H02K 1/2793; H02K 21/026; F04D 29/22; F04D 29/047–0476; F04D 13/0633; F04D 13/0666

See application file for complete search history.

(56) References Cited

U.S. PATENT DOCUMENTS

| | | | | |
|---|---|---|---|---|
| 3,364,866 | A * | 1/1968 | Sato | F04D 13/0666 384/122 |
| 3,671,137 | A | 6/1972 | Ball | |
| 4,277,111 | A | 7/1981 | Gray et al. | |
| 4,319,790 | A | 3/1982 | Thomson | |
| 4,867,633 | A | 9/1989 | Gravelle | |
| 5,125,754 | A | 6/1992 | Ide | |
| 5,358,339 | A | 10/1994 | Konno et al. | |

(Continued)

*Primary Examiner* — Peter J Bertheaud
*Assistant Examiner* — Dnyanesh G Kasture
(74) *Attorney, Agent, or Firm* — Armstrong Teasdale LLP

(57) ABSTRACT

An electric motor assembly includes a stator assembly and a rotor assembly positioned adjacent the stator assembly to define an axial gap therebetween. The stator assembly is configured to induce a first axial force on the rotor assembly. The electric motor assembly also includes an impeller directly coupled to the rotor assembly opposite the stator assembly such that the rotor assembly and the impeller are configured to rotate about an axis. A fluid channeled by the impeller induces a second axial force on the impeller. The electric motor assembly further includes a hydrodynamic bearing assembly including a rotating member coupled to the rotor assembly and stationary member at least partially circumscribing the rotating member such that rotation of the rotating member with respect to the stationary member is configured to induce a third axial force on the rotor assembly.

19 Claims, 8 Drawing Sheets

(56) References Cited

U.S. PATENT DOCUMENTS

| | | | |
|---|---|---|---|
| 5,393,145 | A | 2/1995 | Ide |
| 5,939,813 | A | 8/1999 | Schob |
| 5,951,169 | A | 9/1999 | Oklejas et al. |
| 6,036,435 | A | 3/2000 | Oklejas |
| 6,505,970 | B2 | 1/2003 | Takahashi et al. |

* cited by examiner

CENTRIFUGAL PUMP ASSEMBLIES HAVING AN AXIAL FLUX ELECTRIC MOTOR AND METHODS OF ASSEMBLY THEREOF

BACKGROUND

The field of the disclosure relates generally to centrifugal pump assemblies, and more specifically, to centrifugal pump assemblies that include an axial flux electric motor coupled to an impeller.

At least some known centrifugal pumps include an impeller for channeling a fluid through the pump. The impeller is coupled to a shaft that is also coupled to a rotor of an electric motor such that rotation of the rotor causes rotation of the impeller. In at least some known electric motors, the rotor is spaced from a stator such that there is an ever present axial force of attraction in a first direction between the magnets on the rotor and the steel core of the stator. Additionally, the rotating impeller imparts kinetic energy into the pumped fluid as it spins, which increases the pressure of the fluid. There is a resulting axial suction force in an opposite direction acting on the impeller as this pressure increases. In at least some known centrifugal pumps, when operating at high speeds, the axial suction force is larger than the axial magnetic force and may pull the rotor away from the stator, thus causing interruptions in the operation of the electric motor.

Additionally, in at least some known pumps, the axial magnetic force may cause the rotor to contact the stator when the pump is non-operational, and also for a short duration after rotation initialization but before the impeller draws the rotor away from the stator. During low speed rotation, the rotor and stator may contact each other and cause large friction forces between the two components. Such friction forces may shorten the service lifetime of the electric motor and may also generate undesirable noise.

BRIEF DESCRIPTION

In one aspect, an electric motor assembly is provided. The electric motor assembly includes a stator assembly and a rotor assembly positioned adjacent the stator assembly to define an axial gap therebetween. The stator assembly is configured to induce a first axial force on the rotor assembly. The electric motor assembly also includes an impeller directly coupled to the rotor assembly opposite the stator assembly such that the rotor assembly and the impeller are configured to rotate about an axis. A fluid channeled by the impeller induces a second axial force on the impeller. The electric motor assembly further includes a hydrodynamic bearing assembly including a rotating member coupled to the rotor assembly and stationary member at least partially circumscribing the rotating member such that rotation of the rotating member with respect to the stationary member is configured to induce a third axial force on the rotor assembly.

In another aspect, a pump assembly is provided. The pump assembly includes a pump housing and an electric motor assembly coupled to the pump housing. The electric motor assembly includes a rotor assembly positioned adjacent a stator assembly to define an axial gap therebetween, wherein the stator assembly is configured to induce a first axial force on the rotor assembly. The motor assembly also includes a hydrodynamic bearing assembly including a rotating member coupled to the rotor assembly and stationary member at least partially circumscribing the rotating member. Rotation of the rotating member with respect to the stationary member is configured to induce a second axial force on the rotor assembly. The pump assembly also includes an impeller directly coupled to the rotor assembly opposite the stator assembly such that the rotor assembly and the impeller are configured to rotate about an axis, wherein a fluid channeled by the impeller induces a third axial force on the impeller.

In yet another aspect, a method of assembling a pump assembly is provided. The method includes coupling a rotor assembly to a stator assembly such that an axial gap is defined therebetween and such that the stator assembly induces a first axial force on the rotor assembly. The method also includes coupling a rotating member of a hydrodynamic bearing assembly to the rotor assembly and coupling a stationary member of the hydrodynamic bearing assembly circumferentially about the rotating member. Rotation of the rotating member with respect to the stationary member is configured to induce a second axial force on the rotor assembly. The method further includes coupling an impeller directly to the rotor assembly opposite the stator assembly such that the rotor assembly and the impeller are configured to rotate about an axis. A fluid channeled by the impeller is configured to impart a third axial force on the impeller.

Although specific features of various embodiments may be shown in some drawings and not in others, this is for convenience only. Any feature of any drawing may be referenced and/or claimed in combination with any feature of any other drawing.

DETAILED DESCRIPTION

Figure 1:
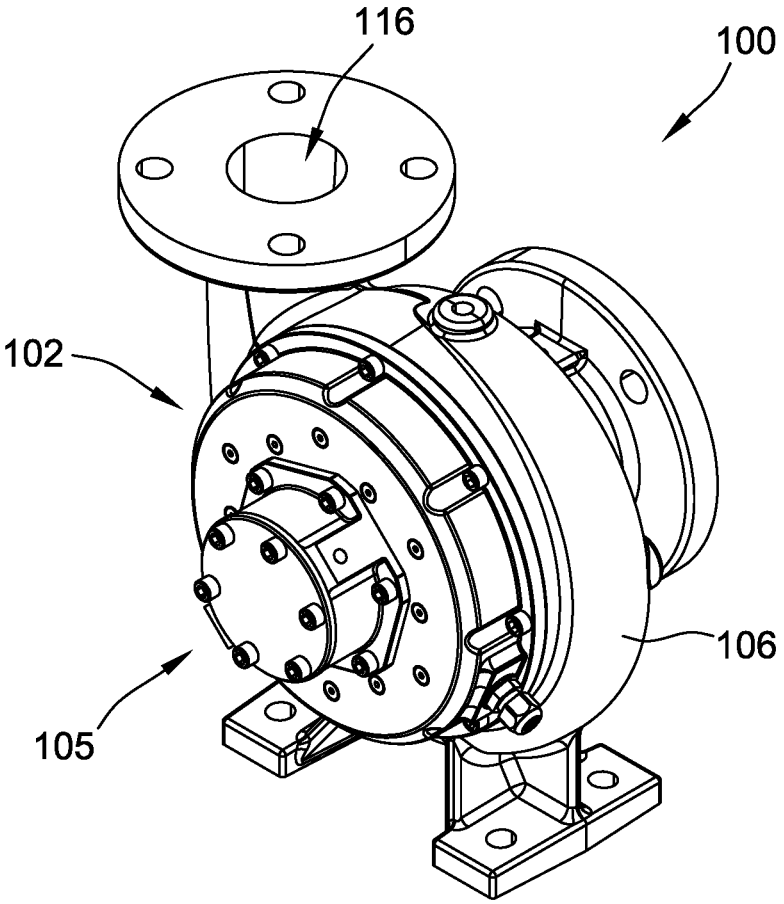
FIG. 1 is a perspective view of an exemplary centrifugal pump illustrating an impeller, an electric motor assembly, and a hydrodynamic bearing assembly.
Figure 2:
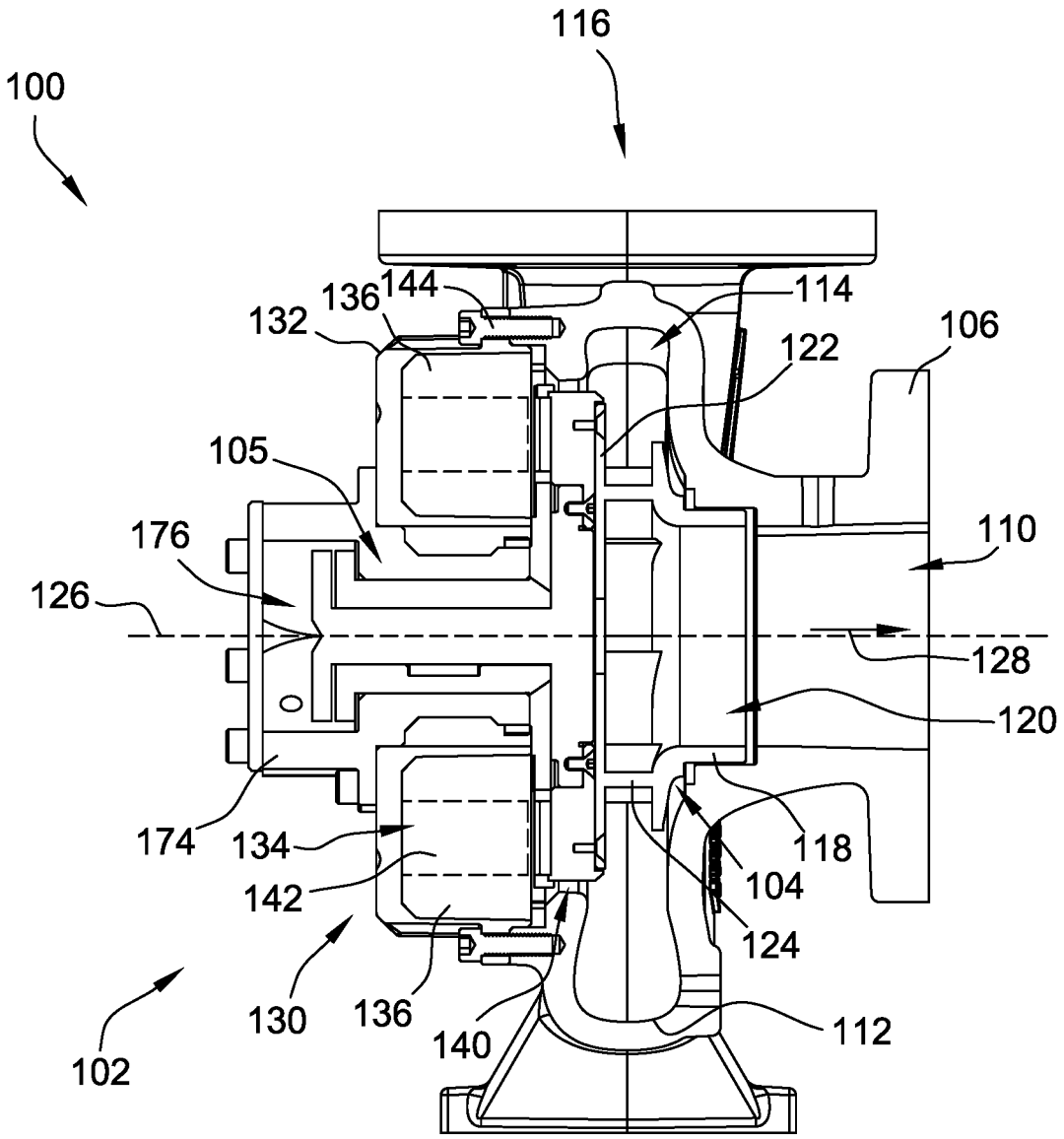
FIG. 2 is a cross-sectional view of the centrifugal pump shown in FIG. 1.
Figure 3:
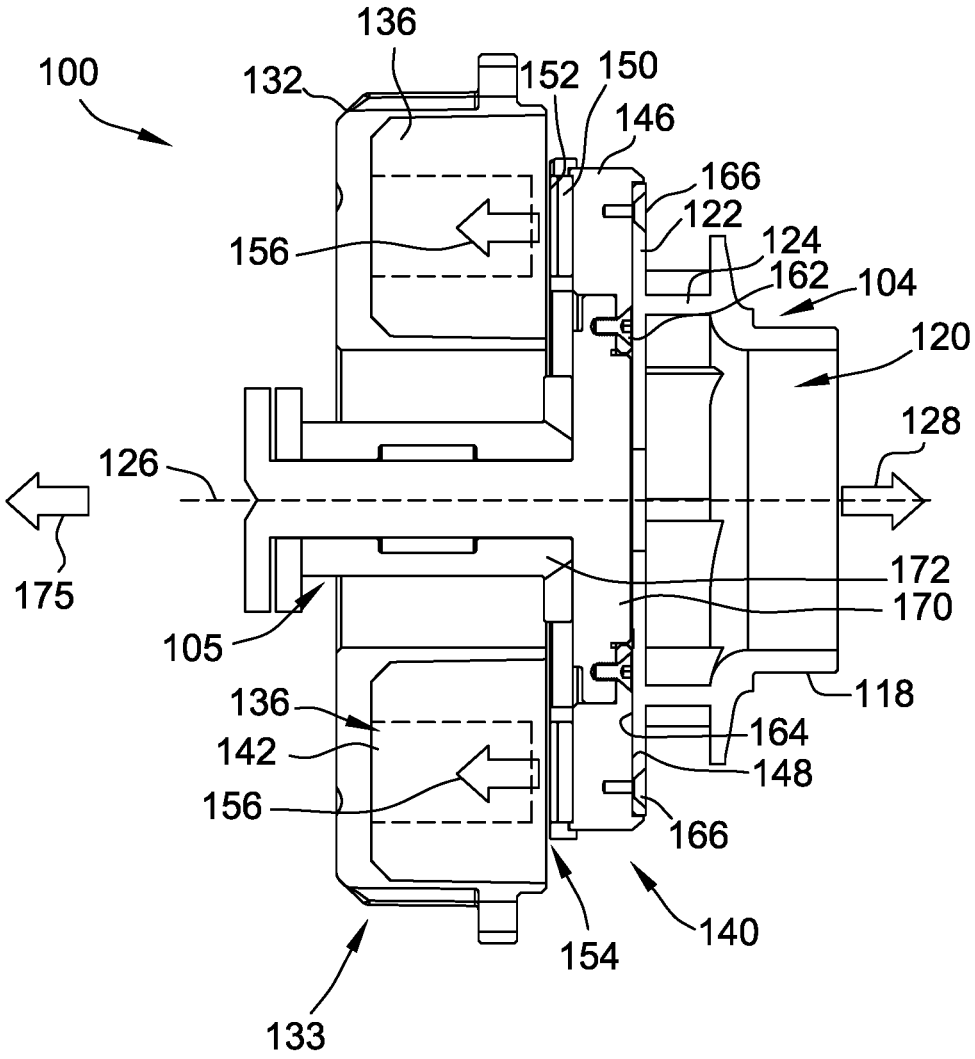
FIG. 3 is a cross-sectional view of the centrifugal pump shown in FIG. 2 with a portion of the hydrodynamic bearing assembly removed for clarity.

FIG. 1 is a perspective view of an exemplary centrifugal pump assembly 100. FIG. 2 is a cross-sectional view of pump assembly 100 illustrating an axial flux electric motor assembly 102, an impeller 104, a hydrodynamic bearing assembly 105, and a pump housing 106. FIG. 3 is an enlarged cross-sectional view of electric motor assembly 102 and impeller 104 with pump housing 106 and a portion of bearing assembly 105 removed for clarity. In the exemplary embodiment, pump assembly 100 includes pump housing 106, which encloses impeller 104 and at least a portion of motor assembly 102. Pump housing 106 includes a fluid inlet 110, a scroll wall 112 defining a portion of a fluid flow channel 114, and a fluid outlet 116. In operation, fluid flows through inlet 110 and is directed through channel 114 around wall 112 until the fluid exits pump 100 through housing outlet 116.

In the exemplary embodiment, impeller 104 is positioned within pump housing 106 and includes an inlet ring 118 that defines an inlet opening 120. Impeller 104 also includes a rear plate 122 and a plurality of blades 124 coupled between inlet ring 118 and rear plate 122. As described in further detail herein, rear plate 122 of impeller 102 is coupled directly to motor assembly 102 such that motor assembly 102 is configured to rotate impeller 102 about a rotational axis 126. In operation, motor 102 rotates impeller 104 about axis 126 to draw fluid in an axial direction into pump housing 106 through housing inlet 110. The fluid is channeled through inlet opening 120 in inlet ring 118 and turned by blades 124 within channel 114 to direct the fluid along wall 112 and radially through housing outlet 116. The amount of fluid moved by pump assembly 100 increases as impeller 104 speed increases such that impeller 104 generates high velocity fluid flow that is exhausted from outlet 116.

Impeller 104 induces kinetic energy into the pumped fluid as it rotates that causes the fluid to pressurize. In the exemplary embodiment, the pressurized fluid imparts an axial suction force 128 on impeller 104. Axial force 128 acts in an axial direction away from motor assembly 102 through pump housing inlet 110. As the speed of impeller 104 increases, both the pressure of the fluid and the resulting axial suction force 128 also increase correspondingly. That is, the magnitude of axial suction force 128 is based on the rotational speed of impeller 104. As described herein, as the magnitude of axial force 128 increases, impeller 104 and a portion of motor assembly 102 are drawn toward inlet 110.

In the exemplary embodiment, motor assembly 102 includes a stator assembly 130 including a stator housing 132, a magnetic stator core 134, and a plurality of conductor coils 136. Stator housing 132 is coupled to pump housing 106 and stator core 134 and conductor coils 136 are positioned within stator housing 132. Motor assembly 102 also includes bearing assembly 105 and a rotor assembly 140. Each conductor coil 136 includes an opening (not shown) that closely conforms to an external shape of one of a plurality of stator core teeth 142 such that each stator tooth 142 is configured to be positioned within a conductor coil 136. Motor assembly 102 may include one conductor coil 136 per stator tooth 142 or one conductor coil 136 positioned on every other tooth 142. Stator core 134 and coils 136 are positioned within stator housing 132, which is coupled to pump housing 106 with a plurality of fasteners 144.

In the exemplary embodiment, a variable frequency drive (not shown) provides a signal, for example, a pulse width modulated (PWM) signal, to motor 102. In an alternative embodiment, motor 102 may include a controller (not shown) coupled to conductor coils 136 by wiring. The controller is configured to apply a voltage to one or more of conductor coils 136 at a time for commutating conductor coils 136 in a preselected sequence to rotate rotor assembly 140 about axis 126.

Rotor assembly 140 is positioned within pump housing 106 proximate channel 114 and includes a back iron or rotor disk 146 having at least a first axial surface 148. Rotor assembly 140 also includes a magnet retainer 150 coupled to rotor disk 146 opposite impeller 104 and a plurality of permanent magnets 152 coupled to magnet retainer 150 using an adhesive. Alternatively, magnets 152 may be coupled to magnet retainer 150 using any retention method that facilitates operation of motor 102 as described herein. In another embodiment, magnets 152 are coupled directly to rotor disk 146.

In the exemplary embodiment, rotor assembly 140 is positioned adjacent stator assembly 130 to define an axial gap 154 therebetween. As described above, voltage is applied to coils 136 in sequence to cause rotation of rotor assembly 140. More specifically, coils 136 control the flow of magnetic flux between magnetic stator core 134 and permanent magnets 152. Magnets 152 are attracted to magnetic stator core 134 such that an axial magnetic force 156 is ever-present across gap 154. As such, stator core 134 of stator assembly 130 induces axial magnetic force 156 to rotor assembly 140 in an axial direction away from impeller 104. More specifically, axial magnetic force 156 acts in a direction opposite of axial suction force 128 of impeller 104. As the size of axial gap 154 decreases, the axial magnetic force 156 between stator assembly 133 and rotor assembly 140 increases. That is, the magnitude of axial magnetic force 156 is based on a length of axial gap 154. Similarly, as impeller 104 speed increases, axial suction force 128 opposite magnetic force 152 also increases.

As best shown in FIG. 3, impeller 104 is directly coupled to rotor assembly 140 opposite stator assembly 130 such that impeller 104 contacts rotor assembly 140 to enable rotation of impeller 104 and rotor assembly 140 about axis 126. As used herein, the term "directly" is meant to describe that rotor assembly 140 is coupled to impeller 104 without any intermediate structure positioned therebetween to separate rotor assembly 140 from impeller 104. More specifically, rotor disk 146 is directly coupled to impeller 104. Even more specifically, rotor disk 146 is directly coupled to rear plate 122 of impeller 104. In one embodiment, axial surface 148 of rotor disk 146 is coupled to and directly contacts an axial surface 164 of rear plate 122 in a face-to-face relationship. In the exemplary embodiment, and as shown in FIG. 3, rotor disk 146 is coupled to impeller back plate 122 using a plurality of fasteners 166. In another embodiment, rotor assembly 140 is integrally formed with impeller 104. More specifically, rotor disk 146 is integrally formed with rear plate 122 of impeller 104 such that rotor disk 146 and rear plate 122 form a single, monolithic component. Generally, rotor assembly 140 and impeller 104 are directly coupled together using any attachment means that facilitates operation of pump assembly 100 as described herein. As described above, conventional pumps include a shaft that couples the rotor assembly to the impeller. However, in one embodiment described herein, as shown in FIGS. 2 and 3, pump assembly 100 does not include a shaft coupled between rotor assembly 140 and impeller 104 as impeller 104 is directly coupled to and contacting rotor assembly 140.

As shown in FIGS. 2 and 3, bearing assembly 105 includes a rotating member 170 coupled to rotor disk 146 with a plurality of fasteners 162 and a stationary member 172 at least partially circumscribing rotating member 170. Additionally, bearing assembly 105 includes a bearing carrier 174 coupled to stator housing 132 of stator assembly 130. Bearing carrier 174 defines a cavity 176 that at least partially houses rotating member 170 and stationary member 172 therein. As described herein, rotation of rotating member 170 with respect to stationary member 172 induces a lifting axial force 175 on rotor assembly 140. More specifically, bearing assembly 105 is a hydrodynamic bearing assembly and rotation of rotating member 170 relative to stationary member 172 induces lifting axial force 175, which causes rotating member 170 to move axially in the direction of axial lifting force 175 and axial magnetic force 156. In the exemplary embodiment, the sum of axial lifting and magnetic forces 156 and 175 is substantially equal to axial suction force 128 to control the size of air gap 154. As such, balancing axial forces 128, 156, and 175 prevents separation of rotor assembly 140 from stator assembly 130.

Figure 4:
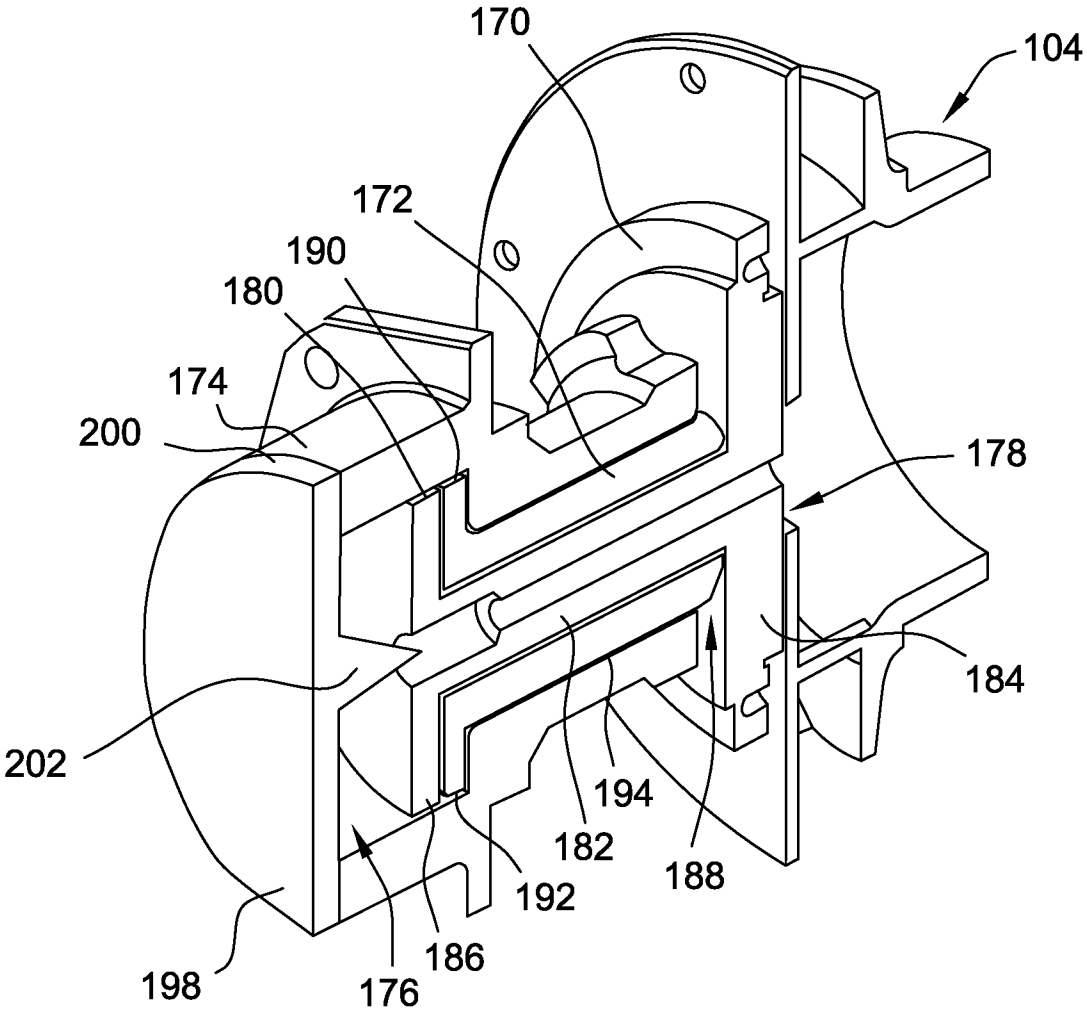
FIG. 4 is a perspective cross-sectional view of the bearing assembly and the impeller.
Figure 5:
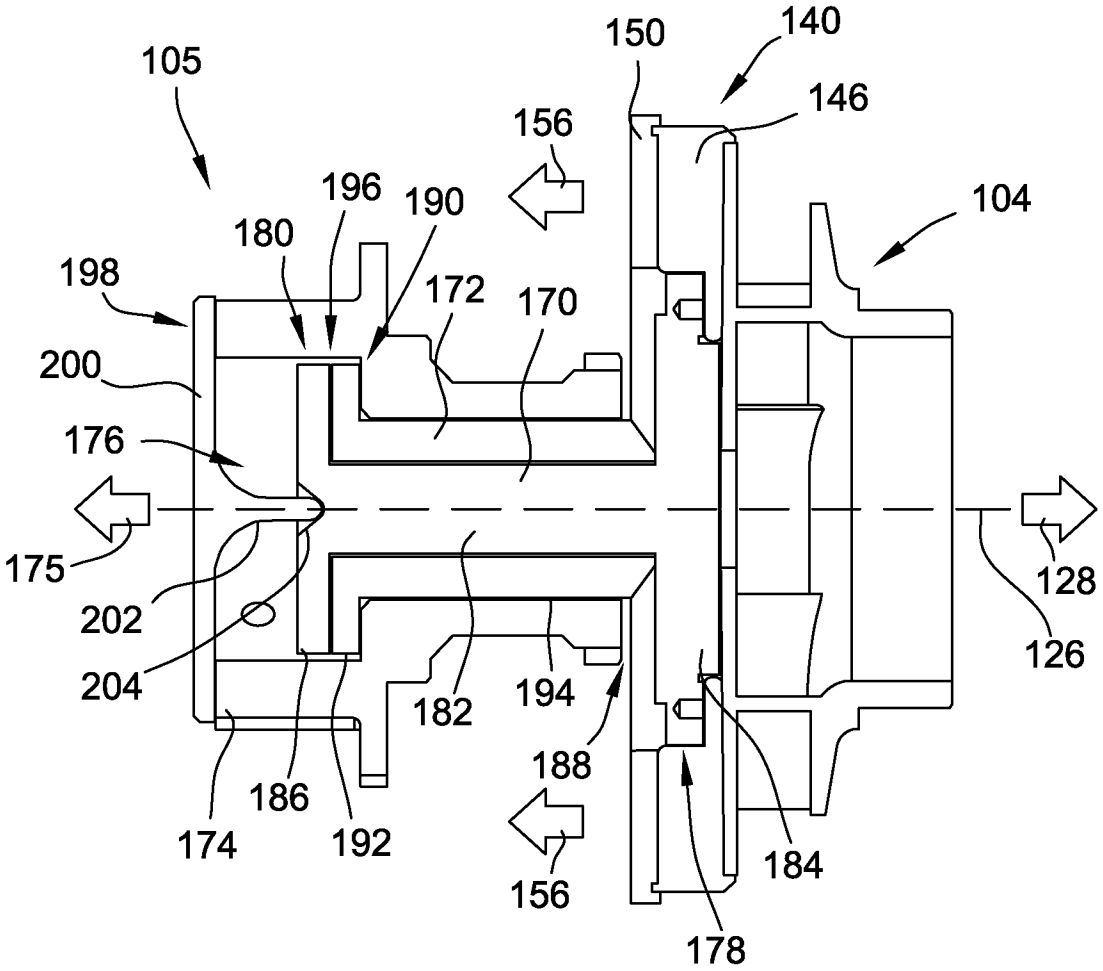
FIG. 5 is a cross-sectional view of the bearing assembly and the impeller shown in FIG. 4.
Figure 6:
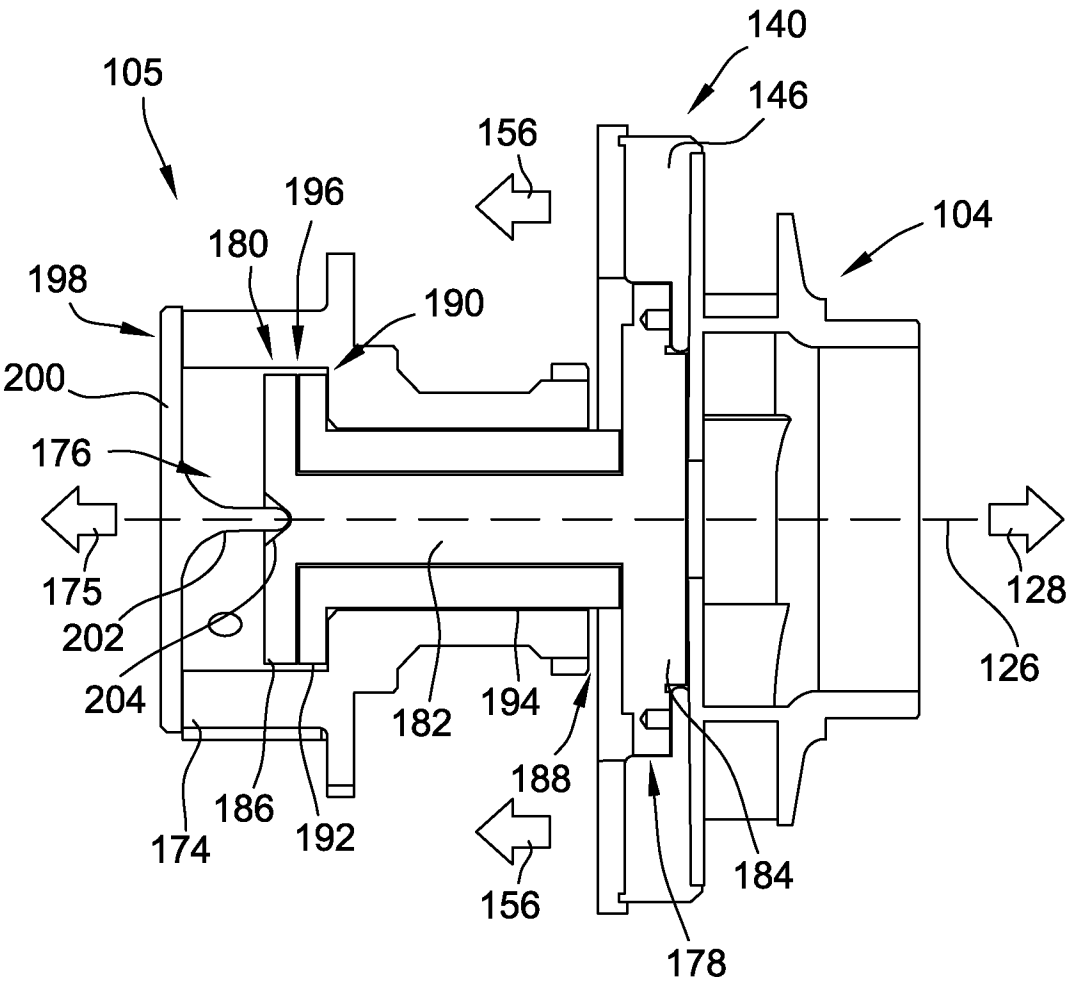
FIG. 6 is a cross-sectional view of an alternative embodiment of a bearing assembly that may be used with the centrifugal pump shown in FIG. 2.
Figure 7:
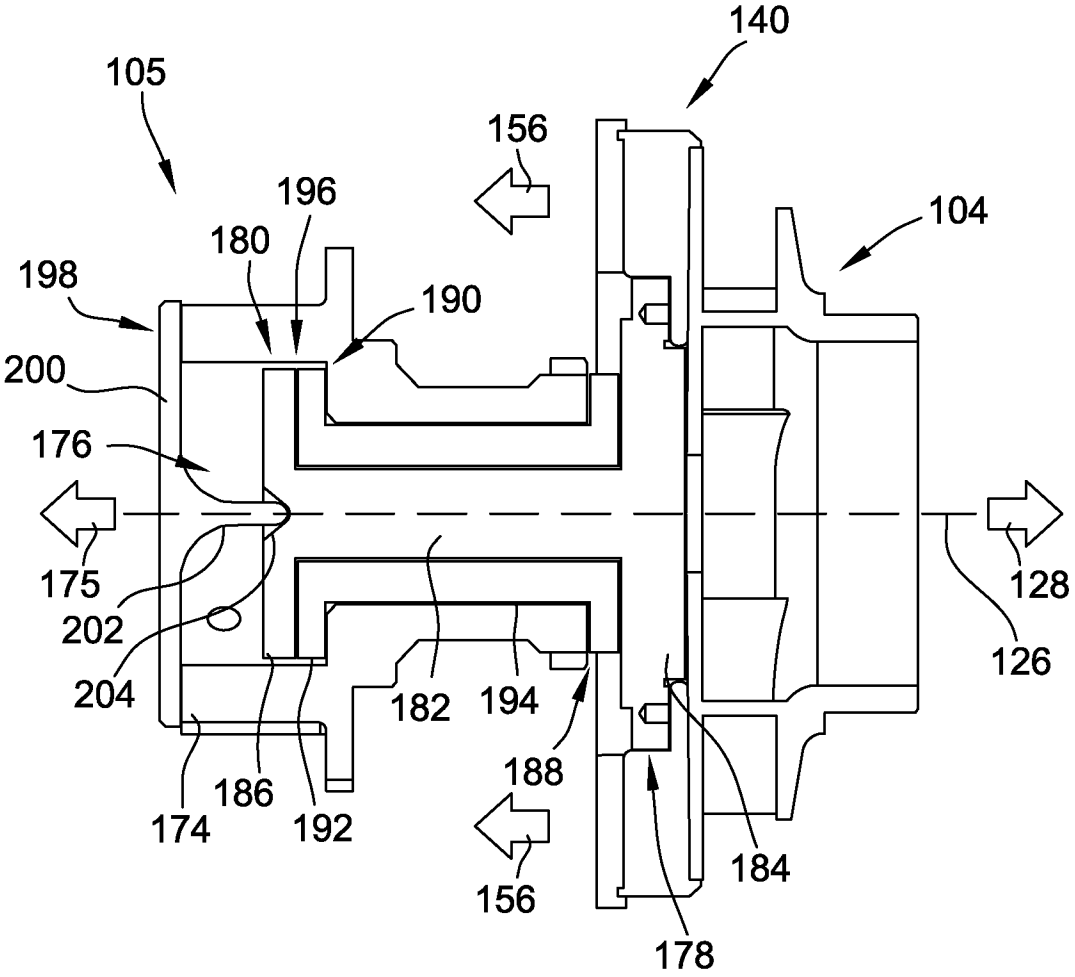
FIG. 7 is a cross-sectional view of another alternative embodiment of a bearing assembly that may be used with the centrifugal pump shown in FIG. 2.

FIG. 4 is a perspective cross-sectional view of bearing assembly 105 and impeller 104, and FIG. 5 is a cross-sectional view of bearing assembly 105 and impeller 104. In the exemplary embodiment, rotating member 170 includes a first end 178, an opposing second end 180, and a cylindrical body 182 extending therebetween. First end 178 includes a disc 184 that is directly coupled to both rotor assembly 140 and impeller 104, and second end 180 includes a rotating bearing plate 186 positioned within cavity 176 of bearing carrier 174. Stationary member 172 includes a first end 188 positioned proximate rotating member first end 178, a second end 190 including a stationary bearing plate 192 positioned adjacent rotating bearing plate 186 within cavity 176, and a tubular body 194 extending between ends 188 and 190. Body 194 of stationary member 172 circumscribes body 182 of rotating member 170. Furthermore, in the exemplary embodiment, first end 188 of stationary member 172 includes a tapered end. In alternative embodiments, first end 188 includes a substantially flat, or planar, end (as shown in FIG. 6). In other alternative embodiments, first end 188 of stationary member 172 includes an end plate (as shown in FIG. 7) that extends radially along disc 184 of rotating member 170. Generally, first end 188 of stationary member 172 includes any geometry that provides support to rotating member 170 against axial magnetic load 156 and prevents contact of rotor assembly 140 and stator assembly 130.

In the exemplary embodiment, rotation of rotating bearing plate 180 relative to stationary bearing plate 190 induces axial lifting force 175 and causes rotating bearing plate 180 to "lift" away from stationary bearing plate 190 to define an axial gap 196 therebetween.

Figure 9:
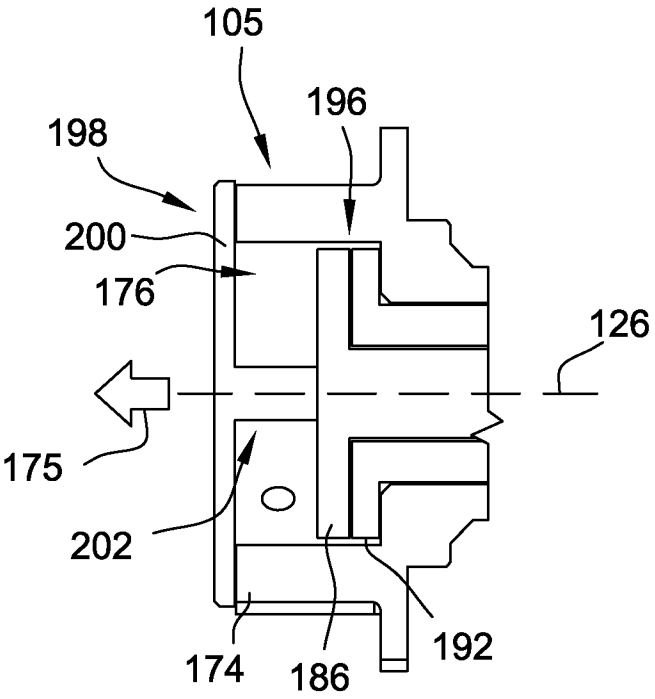
FIG. 9 is a cross-sectional view of another alternative embodiment of a bearing assembly that may be used with the centrifugal pump shown in FIG. 2.
Figure 8:
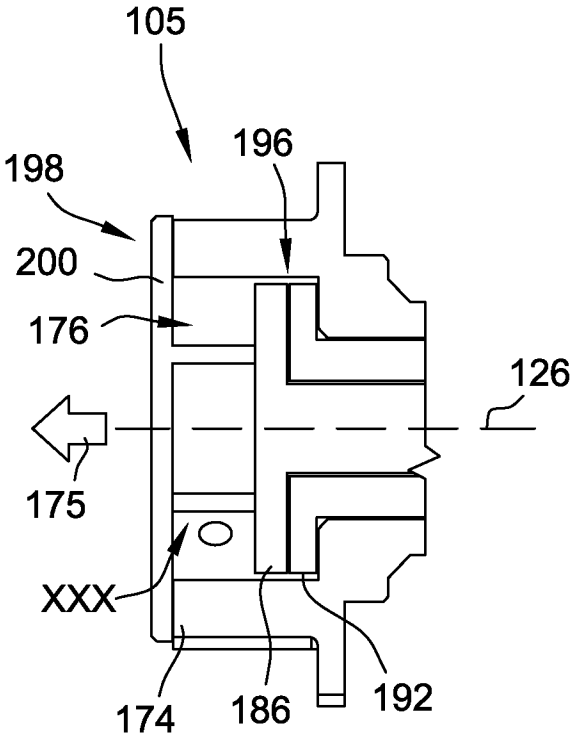
FIG. 8 is a cross-sectional view of yet another alternative embodiment of a bearing assembly that may be used with the centrifugal pump shown in FIG. 2.

As shown in FIGS. 4 and 5, bearing assembly 105 also includes an end cap 198 coupled to bearing carrier 174 opposite rotor assembly 140. End cap 198 includes an end plate 200 coupled to bearing carrier 174 and a spacer member 202 extending axially from end plate 200 into cavity of bearing carrier 174 and toward rotating bearing plate 186. In the exemplary embodiment, spacer member 202 controls the size of air gap 154 between rotor assembly 140 and stator assembly 130 (all shown in FIG. 3). More specifically, as described herein, the hydrodynamic properties of bearing assembly 105 induce lifting axial force 175 on rotating member 170, and therefore rotor assembly 140, at high operating speeds, which draws rotor assembly 140 closer to stator assembly 130 and may decrease the size of air gap 154. Additionally, when non-operational, rotor assembly 140 is drawn toward stator assembly 130 by axial magnetic force 156 and axial suction force 128 does not provide a counter force. In the exemplary embodiment, spacer member 202 engages rotating bearing plate 182 to control the axial movement of rotating member 170 and rotor assembly 140 to prevent contact between the rotor assembly 140 and stator assembly 130 both when operating at high speeds and when motor assembly 102 is non-operational. As shown in FIG. 5, spacer member 202 engages a recess 204 formed in rotating bearing plate 186 to control axial movement of rotating member 170 and rotor assembly 140, and therefore to control the size of axial gap 256. In an alternative embodiment, spacer member 202 includes a tubular structure (as shown in FIG. 8) that engages rotating bearing plate 182. In another alternative embodiment, spacer member 202 includes a substantially solid cylindrical structure (as shown in FIG. 9) that engages rotating bearing plate 182. Generally, spacer member 202 includes any geometry that enables bearing assembly 105 to operate as described herein.

In operation, conductor coils 136 coupled to stator core 134 are energized in a chronological sequence that provides an axial magnetic field which moves clockwise or counter-clockwise around stator core 134 depending on the predetermined sequence or order in which conductor coils 136 are energized. This moving magnetic field intersects with the flux field created by the plurality of permanent magnets 152 to cause rotor assembly 140 to rotate about axis 126 relative to stator assembly 133 in the desired direction. As described above, the magnetic attraction between stator core 134 and magnets 152 creates axial magnetic force 156 that acts in a direction away from impeller 104. Furthermore, because rotor disk 146 is directly coupled to impeller 104, rotation of rotor disk 146 causes rotation of impeller 104. As described above, rotation of impeller 104 pressurizes the fluid flowing therethrough, which induces axial suction force 128 on impeller 104 in a direction away from rotor assembly 140 and opposite that of axial magnetic force 156. Furthermore, rotation of rotating member 170 with respect to stationary member 172 induces lifting axial force 175 on rotor assembly 140 and biases rotor assembly 140 in the same direction as axial magnetic force 156.

In the exemplary embodiment, the sum of axial lifting force 175 and axial magnetic force 156 and 175 is substantially equal to axial suction force 128. As such, axial forces 128, 156, and 175 are substantially balanced to control the size of air gap 156 to prevent extended separation of rotor assembly 140 from stator assembly 130 and to prevent also contact between rotor assembly 140 from stator assembly 130. Such control of the axial gap 156 facilitates extending the service lifetime of pump assembly 100, and, specifically, motor assembly 102.

Exemplary embodiments of the centrifugal pump assembly are described above in detail. The centrifugal pump assembly and its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electric motor assembly comprising:

a stator assembly;

a rotor assembly positioned adjacent said stator assembly to define an axial gap therebetween, wherein said stator assembly is configured to induce a first axial force on said rotor assembly;

an impeller directly coupled to said rotor assembly opposite said stator assembly such that said rotor assembly and said impeller are configured to rotate about an axis, wherein a fluid channeled by said impeller induces a second axial force on said impeller; and a hydrodynamic bearing assembly comprising a rotating member coupled to said rotor assembly and stationary member at least partially circumscribing said rotating member such that rotation of said rotating member with respect to said stationary member is configured to induce a third axial force on said rotor assembly, wherein the first axial force acts on said rotor assembly in a first direction, the second axial force acts on said impeller in a second direction opposite the first direction, and the third axial force acts on said rotor assembly in the first direction.

2. The electric motor assembly in accordance with claim 1, wherein the sum of the first axial force and the third axial force is equal to the second axial force.

3. The electric motor assembly in accordance with claim 1, wherein said rotating member comprises a first end coupled to said rotor assembly, a second end comprising a rotating bearing plate, and a body extending between said first end and said second end, wherein rotation of said rotating bearing plate with respect to said stationary member is configured to induce the third axial force.

4. The electric motor assembly in accordance with claim 3, wherein said stationary member comprises a first end positioned proximate said rotating member first end and a second end comprising a stationary bearing plate positioned adjacent said rotating bearing plate to define a second axial gap therebetween.

5. The electric motor assembly in accordance with claim 4, wherein said stationary member first end comprises one of a tapered end or an end plate.

6. The electric motor assembly in accordance with claim 1, further comprising a bearing carrier coupled to said stator assembly and defining a cavity, wherein at least a portion of said rotating member and at least a portion of said stationary member are positioned within said cavity.

7. The electric motor assembly in accordance with claim 6, further comprising an end cap coupled to said bearing carrier, wherein said end cap comprises a spacer member configured to engage said rotating member to define said axial gap.

8. The electric motor assembly in accordance with claim 7, wherein said spacer engages said rotating member within a recess formed in said rotating member.

9. A pump assembly comprising:

a pump housing;

an electric motor assembly coupled to said pump housing, said electric motor assembly comprising:

a stator assembly;

a rotor assembly positioned adjacent said stator assembly to define an axial gap therebetween, wherein said stator assembly is configured to induce a first axial force on said rotor assembly; and a hydrodynamic bearing assembly comprising a rotating member coupled to said rotor assembly and stationary member at least partially circumscribing said rotating member such that rotation of said rotating member with respect to said stationary member is configured to induce a second axial force on said rotor assembly; and an impeller directly coupled to said rotor assembly opposite said stator assembly such that said rotor assembly and said impeller are configured to rotate about an axis, wherein a fluid channeled by said impeller induces a third axial force on said impeller, wherein the first axial force acts on said rotor assembly in a first direction, the second axial force acts on said impeller in a second direction opposite the first direction, and the third axial force acts on said rotor assembly in the first direction.

10. The pump assembly in accordance with claim 9, wherein the sum of the first axial force and the second axial force is equal to the third axial force.

11. The pump assembly in accordance with claim 9, wherein said rotating member comprises a first end coupled to said rotor assembly, a second end comprising a rotating bearing plate, and a body extending between said first end and said second end, wherein rotation of said rotating bearing plate with respect to said stationary member is configured to induce the second axial force.

12. The pump assembly in accordance with claim 11, wherein said stationary member comprises a first end positioned proximate said rotating member first end and a second end comprising a stationary bearing plate positioned adjacent said rotating bearing plate to define a second axial gap therebetween.

13. The pump assembly in accordance with claim 9, further comprising a bearing carrier coupled to said stator assembly and defining a cavity, wherein at least a portion of said rotating member and at least a portion of said stationary member are positioned within said cavity.

14. The pump assembly in accordance with claim 13, further comprising an end cap coupled to said bearing carrier, wherein said end cap comprises a spacer member configured to engage said rotating member to define said axial gap.

15. A method of assembling a pump assembly, said method comprising:

coupling a rotor assembly to a stator assembly such that an axial gap is defined therebetween, wherein the stator assembly induces a first axial force on the rotor assembly, wherein coupling the rotor assembly comprises coupling the rotor assembly such that the first axial force acts on the rotor assembly in a first direction;

coupling a rotating member of a hydrodynamic bearing assembly to the rotor assembly;

coupling a stationary member of the hydrodynamic bearing assembly circumferentially about the rotating member, wherein rotation of the rotating member with respect to the stationary member is configured to induce a second axial force on the rotor assembly in the first direction;

coupling an impeller directly to the rotor assembly opposite the stator assembly such that the rotor assembly and the impeller are configured to rotate about an axis, wherein a fluid channeled by the impeller is configured to impart a third axial force on the impeller; wherein coupling the impeller comprises coupling the impeller such that the third axial force acts on the impeller in a second direction opposite the first direction.

16. The method in accordance with claim 15, wherein the sum of the first axial force and the second axial force is equal to the third axial force.

17. The method in accordance with claim 15, wherein coupling the rotating member comprises coupling a first end of the rotating member to the rotor assembly such that a rotating bearing plate at a second end of the rotating assembly is spaced from the rotor assembly, wherein rotation of the rotating bearing plate with respect to the stationary member is configured to induce the second axial force.

18. The method in accordance with claim 17, wherein coupling the stationary member comprises coupling a first end of the stationary member proximate the rotating member first end and coupling a stationary bearing plate at a second end of the stationary member adjacent the rotating bearing plate to define a second axial gap therebetween.

19. The method in accordance with claim 15 further comprising:

coupling a bearing carrier to the stator assembly such that at least a portion of the rotating member and at least a portion of the stationary member are positioned within a cavity defined by the bearing carrier; and coupling an end cap to the bearing carrier, wherein the end cap includes a spacer member configured to engage the rotating member to define the axial gap.

* * * * *